US006167640B1

(12) United States Patent
Schaefer

(10) Patent No.: US 6,167,640 B1
(45) **Date of Patent: *Jan. 2, 2001**

(54) ATHLETIC SHOE, IN PARTICULAR SOCCER SHOE

(75) Inventor: Philipp Schaefer, Hannover (DE)

(73) Assignee: Adidas International B.V., Amsterdam (NL)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/010,173

(22) Filed: Jan. 21, 1998

(30) Foreign Application Priority Data

Jan. 21, 1997 (DE) ..... 297 00 950

(51) Int. Cl.[7] ..... A43B 13/22; A43B 13/28
(52) U.S. Cl. ..... 36/98; 36/12; 36/14
(58) Field of Search ..... 36/98, 12, 14, 36/10, 17 R, 58; 12/142 K

(56) References Cited

U.S. PATENT DOCUMENTS

| | | | | |
|---|---|---|---|---|
| 3,570,149 | * | 3/1971 | Kogert et al. | 36/98 |
| 5,285,546 | * | 2/1994 | Hamerl | 36/12 X |
| 5,433,021 | * | 7/1995 | Mahler | 36/12 |
| 5,505,011 | * | 4/1996 | Bleimhofer | 36/55 X |
| 5,685,091 | * | 11/1997 | Yalamanchili | 36/55 |
| 5,737,857 | * | 4/1998 | Aumann | 36/55 X |
| 5,778,473 | * | 7/1998 | Chen | 36/14 X |

FOREIGN PATENT DOCUMENTS

| | | |
|---|---|---|
| 346518 | 1/1922 | (DE) . |
| 89 14 514 U1 | 5/1991 | (DE) . |
| 296 06 284 U1 | 8/1996 | (DE) . |

OTHER PUBLICATIONS

Schuh–Technik, 9, 1988, pp. 848–852, UITIC–Congress at Alicante (Sayers et al.), "Score proof leather, manufacturing and attribute of carrying the same".
Schuh–Technik, 11, 1991, pp. 861–864, "Reversal coating of skiver".

* cited by examiner

*Primary Examiner*—M. D. Patterson
(74) *Attorney, Agent, or Firm*—Herbert L. Lerner; Laurence A. Greenberg; Werner H. Stemer

(57) ABSTRACT

An athletic shoe, such as a soccer shoe, has an upper defining a toe region, an insole connected to the upper, and an outsole secured to the insole. A vamp in the toe region is joined to the insole. The vamp is a full-grain leather composed of a grain layer and a leather fiber layer joined to the grain layer. An elastomeric coating is disposed on and partway penetrates into the leather fiber layer in a region where the fiber layer is joined to the insole. The coating has a thickness above the surface of the leather fiber layer of at least 0.1 mm. The coating may also be disposed in a region adjoining the region where the fiber layer is joined to said insole. The coating may also be reinforced with an embedded reinforcement.

30 Claims, 3 Drawing Sheets

ATHLETIC SHOE, IN PARTICULAR SOCCER SHOE

BACKGROUND OF THE INVENTION

Field of the Invention

The invention relates to an athletic shoe, especially a soccer shoe, including an upper, which has a vamp in the toe region of the shoe that is joined to an insole, and also including an outsole disposed underneath the insole; the vamp comprises a full-grain leather which is composed of a grain layer and a leather fiber layer joined to it.

Athletic shoes must be light in weight and adapt to the foot in an optimal way. In soccer shoes, the toe of the shoe in particular must comprise a soft, yielding leather, to give the soccer player the requisite feel of the ball. On the other hand, the vamp region of athletic shoes, and more particularly in the toe region, are subject to severe dynamic tensile, compressive, impact, shock and abrasion stresses. The leather is also stressed by wetness, lawn fertilizer residues, sweat, and sand, which is abrasive. Especially if shoe care including reoiling is neglected, the shoe upper is quickly destroyed by these stresses and factors, and primarily in the vamp region. Another cause of premature destruction of the upper especially in the vamp region is the major persistent stretching, which is required in manufacture to deform the upper and simultaneously join it to the insole. As a rule, that joint is created by a process known as lasting. In that operation, the edge region of the upper, spread out on a last, is pulled over the insole that extends as far as the edge of the last and is turned in at that location, and the inturned lasting edge thus formed is secured to the underside of the insole, preferably with an adhesive.

In another prior art method known as the Strobel lasting method, the upper is first stitched to the insole, and the upper, together with the stitched insole, is pulled onto a last and shaped. In the Strobel lasting method, the insole must not stretch, and so the shoe is shaped solely by the stretching of the upper as it is pulled onto the last. The upper in the vamp region is usually stretched about 20%, so that here particular demands in terms of tear strength are made of the upper, but also in terms of the resistance to stitches pulling out, since after all in Strobel lasting the upper is stitched to the insole.

These demands made of the upper, particularly in the vamp region, have thus far made it impossible, or possible only with an increased rate of customer complaints, to use an upper of only slight thickness of the kind that for the reasons given at the outset is especially desirable in athletic shoes. For athletic shoes and especially soccer shoes, as a rule leather from cattle with a thickness of more than 1.4 mm has previously been used. The shoes made from that leather are heavy, are stiff in the vamp region, and impede the feel of the ball in playing soccer.

The use of full-grain leather, especially for the vamp, has numerous advantages. However, it is disadvantageous that such full-grain leather comprises two layers, namely a grain layer and a leather fiber layer joined to it. By nature, these two layers are not very firmly bonded to one another. It is true that the bond between these two layers can be improved within narrow limits by means of the type of tanning, post-tanning and/or oiling, but the danger nevertheless exists that the two layers will separate at the inturned lasting edge, especially whenever the grain layer, as is usually necessary, has been nearly completely removed before the application of the adhesive in the inturned lasting edge by being roughened or ground down, so that the adhesive can anchor itself in the fibrous structure of the leather fiber layer. In athletic shoes in general, shoe sole adhesion of at least 30 N per 10 mm of width between the upper and the insole is demanded. If the grain layer in the inturned lasting edge is not completely removed, then a separation occurs there between the grain layer and the leather fiber layer and as a rule these two layers are already separated if a force of less than 16 N per 10 mm of width is applied. This is true for both leather from cattle and for kangaroo leather.

Since the grain leather, with its dense, cornified callous surface offers excellent protection against abrasion and makes it harder for dirt and water to penetrate the leather, a loss of this grain layer means that these properties are lost as well. Moreover, this weakens the leather in the particularly severely stressed zone of the inturned lasting edge, which is a substantial disadvantage. Since roughening or grinding down of the grain layer is always done mechanically, usually by hand using rotating disks, often not only the grain layer but also part of the leather fiber layer is ground off, which further weakens this critical zone.

Another disadvantage is that in full-grain, soft leather the skin, for the same thickness, has very different density and strength properties at different locations and also has a highly variable leather fiber structure. It can therefore happen that even if the portions of the hide from which the vamp is cut are suitably selected, regions of lesser density and strength will be located in the region of the inturned lasting edge, so that the strength of the bond between the vamp and the insole and above all between the vamp and the outsole are decreased still further.

SUMMARY OF THE INVENTION

It is accordingly an object of the invention to provide an athletic shoe, and in particular a soccer shoe, which overcomes the above-mentioned disadvantages of the prior art devices and methods of this general type and which exhibits the desired softness and flexibility in the vamp region as well as the requisite strength and resistance. In particular, the bond with the insole and above all the outsole in the region of the inturned lasting edge should have the necessary strength, to enable resisting the stresses occurring during athletics. Moreover, the destruction of the leather in the region of the last insert from external factors should be prevented or at least substantially reduced. Another object of the invention is to improve the strength of the bond between the grain layer and the leather fiber layer of the full-grain leather. An increase in strength should also be attained in a visible region of the vamp adjoining the inturned lasting edge.

With the foregoing and other objects in view there is provided, in accordance with the invention, an athletic shoe, comprising:

an upper defining a toe region, an insole connected to the upper, and an outsole underneath the insole;

a vamp at the toe region of the upper joined to the insole, the vamp being formed of a full-grain leather composed of a grain layer and a leather fiber layer joined thereto;

a coating of elastomeric material disposed on and partway penetrated into the leather fiber layer solely in a region where the leather fiber layer is joined to the insole, and optionally also in an adjoining region, the coating having a thickness above a surface of the leather fiber layer of at least 0.1 mm.

In other words, the objects of the invention are satisfied in that the leather side is provided, solely in the region where it is joined to the insole and optionally also in an adjoining region, with a coating of an elastomeric material that partly penetrates the leather, and whose protruding level from the surface of the leather side is 0.1 mm or more. The coating brings about a reinforcement of the leather in the critical regions, namely in the region where the connection with the insole and the outsole is made, and optionally in a visible region immediately adjoining it, which is subjected to major mechanical stresses and strains during athletics, without any sacrifice in comfort, softness and flexibility of the remaining portion of the vamp, and assuring an optimal feel of the ball when playing soccer. Since the critical regions as a result of the coating undergo appropriate reinforcement, it is possible to make the vamp from a full-grain natural leather of less thickness, for instance less than 1.2 mm, thereby attaining still further improvement in the desired properties of the athletic shoe. By the application of the coating, a reinforcement is made in the region of the inturned lasting edge such that there as well the required roughening of the grain layer for gluing on the outsole can be effected without disadvantages and above all without requiring special precautions.

Because the coating partly penetrates the leather and in so doing fills up virtually all the voids and embeds the protruding leather fibers, an optimal bond is assured between the coating and the leather fiber layer.

A further increase in strength is obtained if reinforcing means are embedded in the coating. The reinforcement may comprise a thin inlay of a textile material, such as a woven or knitted fabric, which can be stitched to the leather prior to the coating.

A considerable improvement in tear strength, resistance to tear propagation, and resistance to stitches coming out is attained where the knitted fabric embedded in the coating comprises synthetic material with a weight per unit of surface area of less than 80 $g/m^2$ and a thickness of less than 0.25 mm. This knitted fabric is inseparably bonded to the leather fiber layer via the coating. In that case, the vamp, for instance of soft full-grain leather from cattle with a thickness of 0.9 mm, can be improved at the stress points in such a way that after the coating is applied, it has the mechanical properties of a full-grain leather from cattle that has a thickness of 1.6 mm, while conversely the coated vamp has a thickness of only 1.25 mm.

The mechanical properties of the coating can also be improved by reinforcing the coating with ground or cut fibers with a length of between 0.01 and 0.3 mm that are disposed in the coating.

By such reinforcing means, a force for stretching the leather in the critical regions is needed that corresponds to the force needed to stretch a full-grain leather with a thickness of 1.6 mm.

It is especially advantageous if the reinforcement is formed by at least one seam penetrating both the grain layer and the leather fiber layer. Thus the grain layer and leather fiber layer are stitched together by this seam, so that the force needed to separate these two layers must be substantially greater. The seam also forms a reinforcement for the coating, which further improves the effectiveness thereof. Moreover, the making of the seam creates pierced openings in the leather, which enable a deeper penetration of the coating material into the leather and sometimes even complete penetration of both the leather fiber layer and even the grain layer. The seam also acts like a wick, through which the coating material is absorbed into the leather.

In accordance with another feature of the invention, the thread which forms the seam comprises synthetic fibers, such as polyamide fibers. It has proved to be especially expedient if the thread is a polyaramide of the kind sold under the trademark KEVLAR®. The thread preferably has a thickness between 0.22 and 0.35 mm.

Since the thread pierces the leather fiber layer and grain layer, the thread is also present on the surface of the grain layer, which has advantages in securing the outsole. The outsole can be produced separately and glued to the insole with the turned-in lasting edge or injection molded or foamed onto this insole. In each case, the seam forms an aid in anchoring for securing the outsole. The inturned lasting edge can be roughened by any conventional process after one or more seams have been made. Especially when the thread is polyaramide, the thread is so stable that the grain layer can be roughened without completely destroying the thread. It has been demonstrated that the grain layer can be roughened between the threads, while the threads themselves are not roughened or are roughened only such that fibers protruding from their surface are created, which provide additional anchoring of the adhesive in the case of glued-on outsoles or of the liquid outsole material in the case of outsoles attached by injection molding or foaming. In that case, even if the grain layer is virtually completely preserved in the region of the inturned lasting edge, extreme sole adhesion values of more than 70 N per 10 mm of width are attained.

Preferably, the thread is even partly removed in the roughening operation, and in the case of roughening or partial removal of the thread the further advantage arises that the lubricants present in the thread, which are a hindrance to good bonding with the adhesive, are removed. The adhesive is then absorbed into the leather via the parts of the thread located in the stitch holes, and bonds to the coating that has penetrated into the leather fiber layer, thus achieving an especially firm bond of the outsole with the leather. Especially where a very fine sandpaper is used for the roughening, the processing in the synthetic material comprising the thread creates radicals, which along with a mechanical anchoring of the adhesive in the thread also lead to a quasi-chemical bond between the adhesive and the thread.

Due to the fact that the radicals lose their effect as time elapses, it is suggested that the adhesive be applied immediately after the roughening.

In accordance with again another feature of the invention, the seam comprises an upper thread and a lower thread, and at least the upper thread is formed by synthetic fibers. Since threads of polyaramide for instance are expensive, this is a rather economical feature, because for the purposes of the invention it suffices for the lower thread to be of cotton, for instance, or an inexpensive polymer material.

However the seam may also comprise a single thread, sewn in a chain stitch, which is preferably formed of synthetic fibers. Chain stitches offer more anchoring opportunities, and thus the number of seams to be made can be reduced. The risk in chain stitching that the seam will come open is overcome by means of the coating.

At least one seam extends approximately parallel to the vamp edge. This seam is located in the region of the inturned lasting edge and is therefore covered by the outsole and is not visible in the finished shoe. In order to increase the length of the seam, the seam is preferably a zig-zag seam. In a practical version, two or three or more such parallel zig-zag seams are provided in the inturned lasting edge.

In accordance with again a further feature of the invention, it is also possible for the seam to be composed of portions extending crosswise to the vamp edge, which preferably protrude into a region of the coating not covered by the outsole. By means of such seams, especially abrasion-threatened points in the toe region of the shoe can be protected as a supplement to a coating applied there. These seams can then be provided both in the visible region of the vamp and in the region that is not visible in the finished shoe, because it is covered by the outsole. The especially threatened points at the toe of the shoe are then protected against abrasion on the inside and on the outside, and an additional connection is made there between the grain layer and the leather fiber layer.

In the lasting operation, creases often occur in the toe region at the edge of the inturned lasting edge and must be removed by grind-down before the outsole is secured. Because the grinding is made more difficult by seams present in this region, especially when the seams involve synthetic fibers with high abrasion resistance, according to a further characteristic of the invention an edge region immediately adjacent the vamp edge is kept free of seams. Accordingly the seams are expediently provided only in the middle region of the inturned lasting edge and optionally in the visible region adjoining the edge of the insole.

As already mentioned, the coating must penetrate the leather partway, and it is expedient if the coating penetrates the leather fiber layer completely at some points and penetrates into the grain layer, because this improves the bond between the leather layer and the grain layer. In accordance with a further feature of the invention, this can be attained by providing that the vamp, at least in individual locations where the coating is applied, is provided with a fine pore perforation. The perforation can be produced mechanically by means of fine indentations or needle piercing, or can also be accomplished by spark discharge utilizing the corona effect. It is especially advantageous if along with the natural pores in the leather, in addition at least 18 and preferably more than 45 pores, formed by the perforation, are provided per square centimeter.

In accordance with yet a further feature of the invention, a strip having a width between 2 mm and 8 mm that immediately adjoins the vamp edge is kept free of the coating. The strip can be more easily processed in the lasting operation and when the outsole is applied.

In accordance with another feature of the invention, the coating may comprise a solidified, finely dispersed polyurethane dispersion, a solidified polyurethane solution, or a polyurethane reaction mixture. Expediently, the coating has a hardness between 33 and 95, preferably between 45 and 70 Shore A. The coating should have a maximum thickness of 0.45 mm.

As already noted, especially deep penetration of the coating into the leather fiber layer is advantageous. Such deep penetration is promoted where the coating material is applied under the influence of increased pressure and/or a vacuum. Accordingly the liquid coating material is expediently forced or absorbed into the leather layer. This can be accomplished by way of example by placing a pressure proof cap on those points where the coating material is applied, and attaching the space enclosed by the cap to a source of compressed air or a vacuum device.

Other features which are considered as characteristic for the invention are set forth in the appended claims.

Although the invention is illustrated and described herein as embodied in an athletic shoe, in particular soccer shoe, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
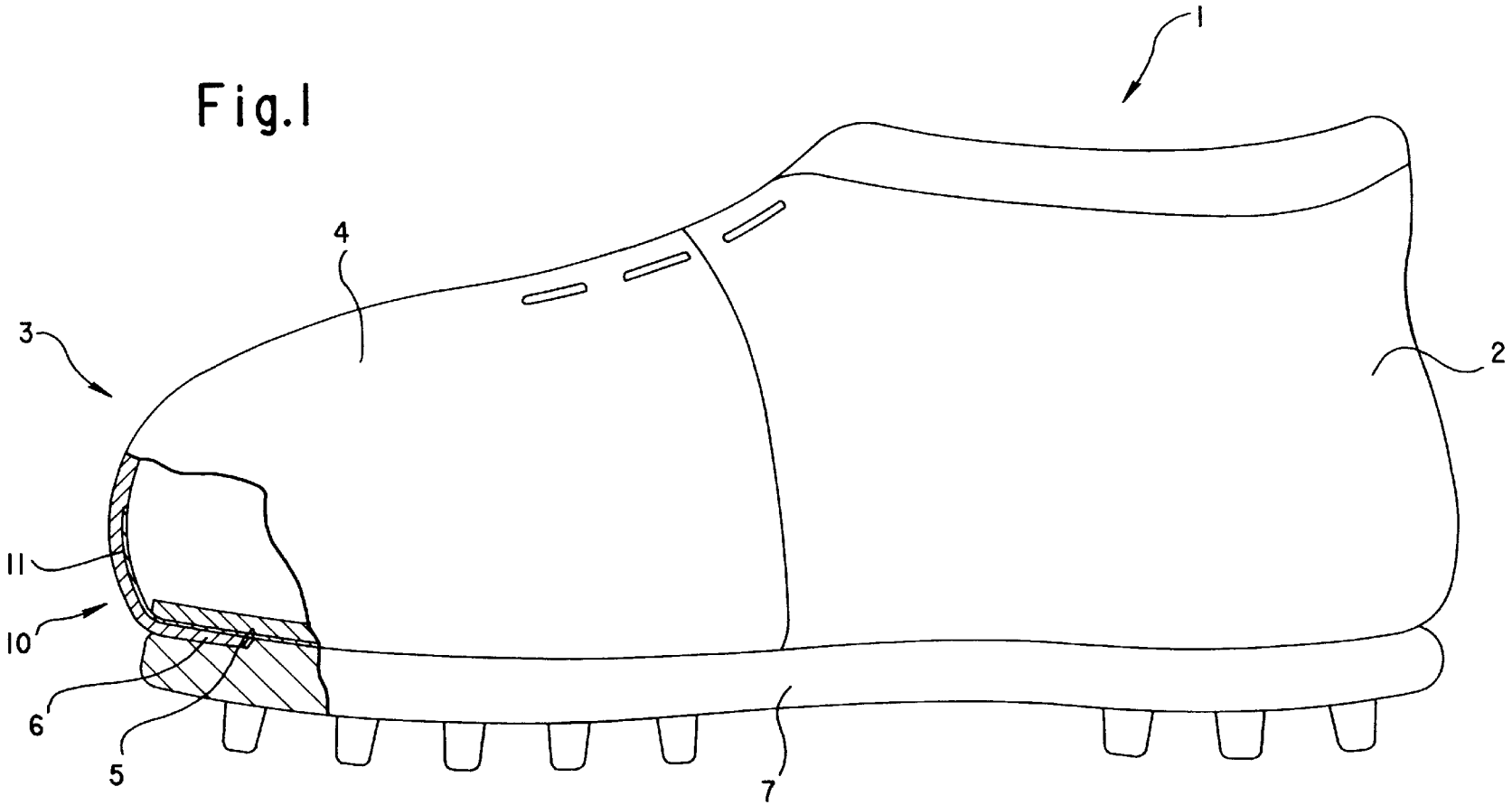
FIG. 1 is a partly broken away, partly sectional side elevational view of an exemplary embodiment of the invention.

Before referring to the drawing figures with specificity, the following describes the manufacture of a soccer shoe according to the invention, by way of an exemplary embodiment: The vamp of a shoe to be produced is stamped out of a piece of kangaroo leather with a thickness of 0.7 mm. Next, three zig-zag seams extending parallel to the vamp edge and to one another are made, piercing both the grain layer and the leather fiber layer. The zig-zag seams are located in a region that subsequently forms the inturned lasting edge. Seams extending crosswise to the zig-zag seams are also made and protrude partway into the visible region of the vamp outside the inturned lasting edge. Four such seams per 12 mm in width are formed. The seams comprise polyaramide threads. Subsequently, needles are used to form a perforation with fine pores in the region to be coated. That region protrudes somewhat past the inturned lasting edge and in any case also covers the region provided with the transverse seams. After the coating material is applied, the coated region is covered with a cap, and compressed air is supplied to the space enclosed by the cap, as a result of which the coating material is forced into the leather layer. The perforation made by the needles and the stitches created in the production of the seams assure that the coating material will penetrate partway to the grain layer. The penetration of the coating material into the leather is also promoted by the wicking action brought about by the seams.

After the coating, the leather has an increase in thickness of approximately 0.3 mm, including the threads partly embedded in the coating.

An insole is then affixed to a last, in such a way that it extends as far as the edge of the last; the upper leather with the vamp is placed over the last, and the inturned lasting edge is joined to the insole by adhesive bonding. The creases created at the edge of the inturned lasting edge are removed by grinding, and this removes the grain layer and the threads, for the most part. Next, the inturned lasting edge is painted to saturation with a dual-component polyurethane adhesive, and after the ventilation period has elapsed is pressed together with a prefabricated polyurethane outsole. In an athletic shoe made in this way, after 24 hours, sole adhesive values in the toe region of more than 48 N per 10 mm in width are ascertained, and an abrasion resistance in the visible region of the seams is ascertained in which the leather, after 500 abrasion cycles in accordance with DIN 53339, had approximately half the abrasion resistance, at those places where there are no seams, compared with the places provided with seams.

Referring now to the figures of the drawing in detail and first, particularly, to FIG. 1 thereof, there is seen a soccer shoe 1 with an upper 2, which in the toe region 3 of the shoe comprises a vamp 4 that is joined to an insole 5 via a so-called inturned lasting edge 6. An outsole 7 is secured to the underside of the insole 5, covering the inturned lasting edge 6. The outsole 7 can either be produced separately and joined to the insole 5 and the turned-in lasting edge 6 by an adhesive (e.g. a dual-component adhesive), or can be injection molded or foamed onto the insole 5 and the inturned lasting edge 6. In the latter case, the outsole 7 is preferably of polyurethane.

Figure 2:
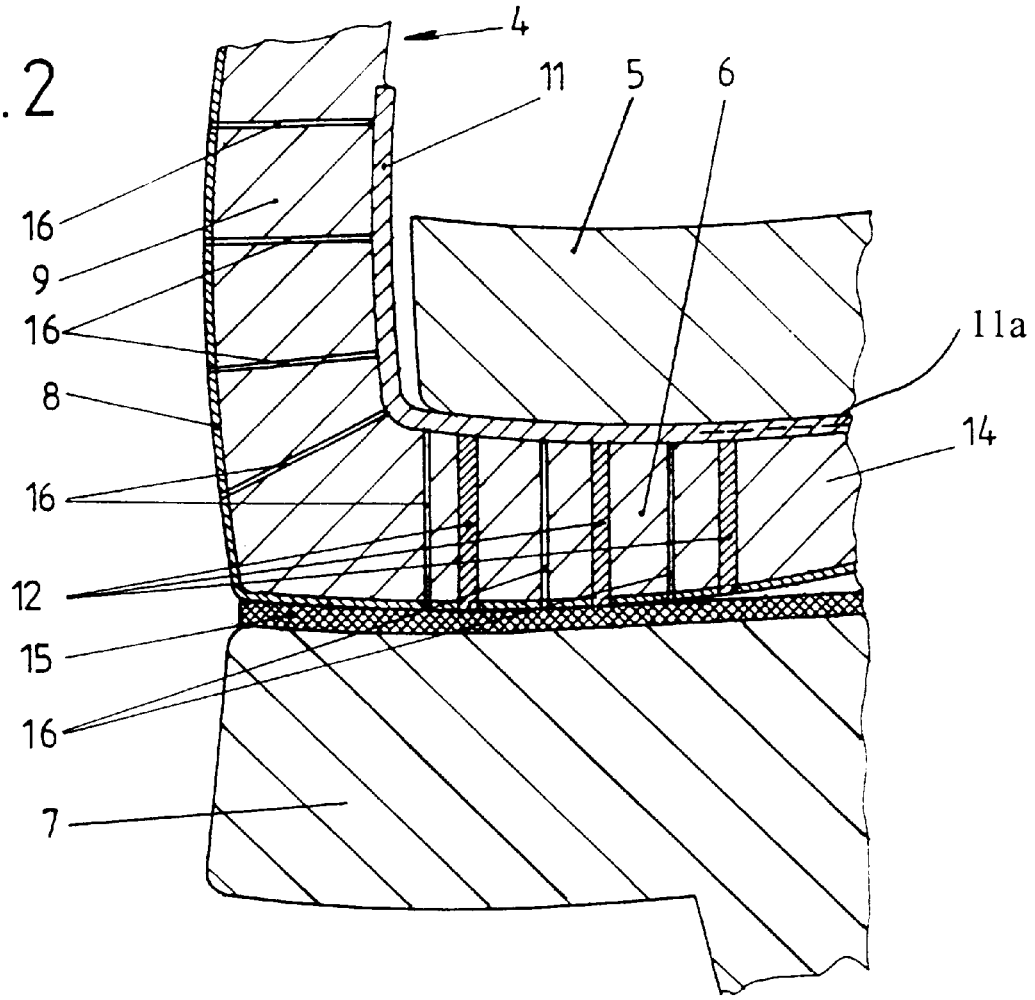
FIG. 2 is a partial sectional view of a detail of FIG. 1, on an enlarged scale.

Referring now more specifically to FIG. 2, the vamp 4 is made from full-grain leather, preferably leather from cattle or kangaroo leather. The vamp leather comprises a grain layer 8 and a leather fiber layer 9 joined to it. In the region of the inturned lasting edge 6 and preferably in an adjoining region 10 that is subject to major mechanical stresses, the leather fiber layer 9 of the vamp 4 is provided with a coating 11 of an elastomer material, which surrounds the protruding fibers of the leather fiber layer 9 and penetrates partway into the leather fiber layer 9 and is thereby anchored in the leather fiber layer. The coating 11, by which the thickness of the vamp 4 is increased by at least 0.1 mm, brings about a reinforcement of the vamp 4 in the region of the inturned lasting edge and in those regions where great strength and resistance to mechanical stresses and strains is necessary. As a result, the full-grain leather itself can be thin and therefore soft and clinging.

Reinforcing means are embedded in the coating 11; in the exemplary embodiment shown, these reinforcing means are formed by seams 12 that pierce the grain layer 8 and leather fiber layer 9. The threads forming the seams 12 are at least partly of synthetic fibers and preferably polyaramide. By way of example, such threads or yarns are commercially available under the mark KEVLAR® (E. I. DuPont De Nemours and Company). If the seams 12 comprise an upper thread and a lower thread, then at least the upper thread is formed by polyaramide fibers, while conversely the lower thread for the sake of economy can comprise cotton or an inexpensive polymer material, for instance.

Instead of the seams 12 or in addition thereto, a knitted fabric 11*a* can be embedded into the coating 11; it preferably comprises synthetic material with a weight per unit of surface area of less than 80 g/m$^2$ and a thickness of less than 0.25 mm. Ground or cut fibers with a length between 0.01 and 0.3 mm can also be embedded in the coating 11.

Figure 3:
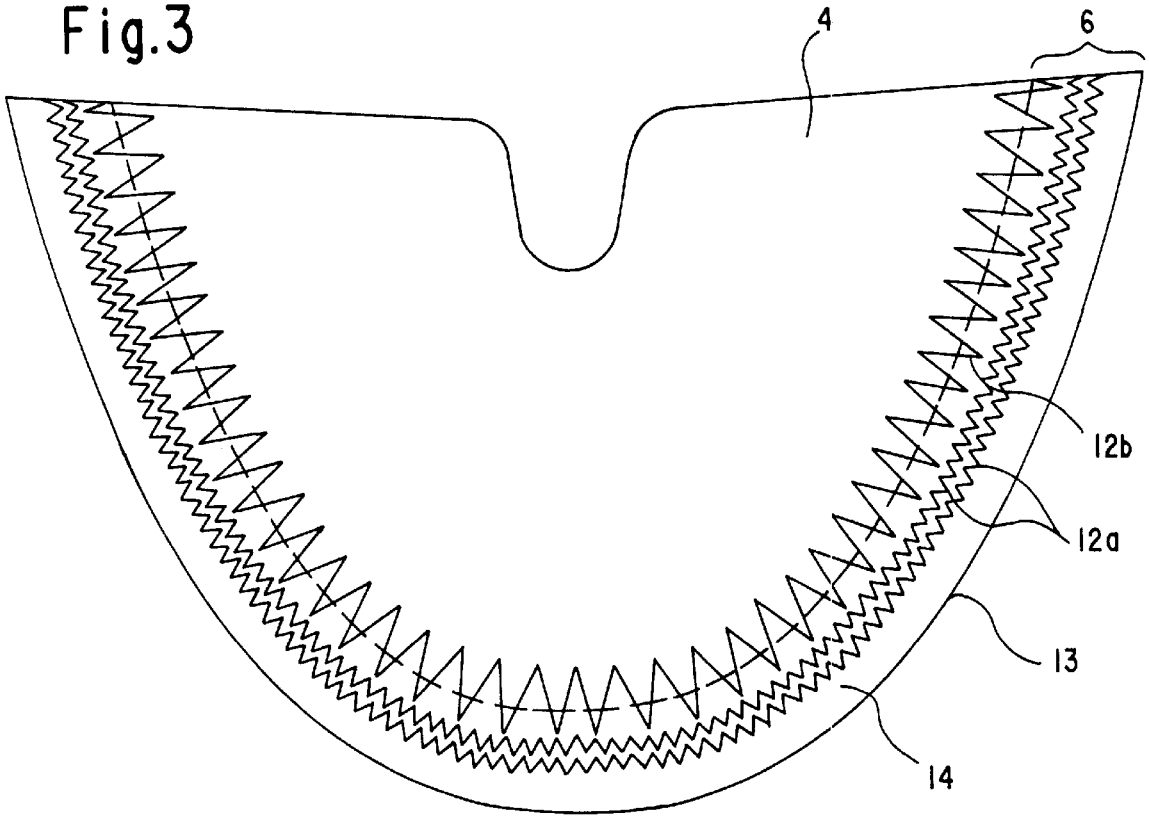
FIG. 3 is a plan view onto a vamp of the soccer shoe according to the invention.

As can be seen from FIG. 3, two zig-zag seams 12*a*, extending parallel to one another and to the vamp edge 13, are provided in the region of the inturned lasting edge 6. The inner boundary of the lasting edge 6 is indicated by dot-dashed lines; as can be seen from FIG. 2, these seams join together the grain layer 8 and the leather fiber layer 9. The edge region 14 immediately adjacent the vamp edge 13 is kept free of seams, so that when this region is ground down the seams are not a hindrance. Such grinding down is necessary, since in the formation of the inturned lasting edge in this edge region 14, creases are created as a rule, which must be ground down before the outsole 7 is attached.

The seams 12 not only form a kind of reinforcement in the coating but also, since they are also effective on the surface on the grain layer 8, bring about better anchoring of the outsole 7 by means of the applied adhesive 15 (see FIG. 2). The requisite roughening of the grain layer 8 in the region of the inturned lasting edge 6 for the sake of better adhesion of the adhesive does not have to be performed carefully in this case, and it is also possible to remove the grain layer 8 entirely without attendant disadvantages. By means of the roughening operation, the seams 12 are also roughened, but without being destroyed completely, so that protruding fibers and radicals are formed that are useful for better anchoring and a quasi-chemical bond. The pierced holes formed in the production of the seams not only bring about a deeper penetration of the coating material into the full-grain leather of which the vamp 4 is made but also allow a penetration of the adhesive, with which the outsole 7 is secured, into this leather material, thereby also improving the anchoring of the outsole. A wicking action is also attained by means of the seams 12, as a result of which the coating material 11 is absorbed into the leather material.

In addition, for instance by fine punching of the vamp 4 with needles, a perforation of the vamp can be formed. The resultant fine pores 16 also improve the penetration of the coating material 11 into the full-grain leather that forms the vamp.

Besides the seams 12*a* mentioned, which are located inside the region of the inturned lasting edge 6, an additional seam 12*b* may be provided, which is composed of portions extending crosswise to the vamp edge and which protrudes out of the region of the inturned lasting edge 6. This seam 12*b*, which is shown only in FIG. 3, brings about a reinforcement of the vamp in the visible region, adjacent the inturned lasting edge that is not visible in the finished shoe, at those points where the vamp 4 is exposed to particular stresses and strains.

The coating 11 by way of example comprises a solidified polyurethane solution, or a solidified finely dispersed polyurethane dispersion, or a polyurethane reaction mixture, and has a maximum thickness of 0.45 mm and a hardness of between 45 and 70 shore A.

Full-grain leathers are understood here also to include leather whose grain surface has been slightly leveled before a finish is applied.

I claim:

1. An athletic shoe, comprising:

an upper defining a toe region, an insole connected to said upper, and an outsole disposed underneath said insole;

a vamp at said toe region of said upper joined to said insole, said vamp being formed of a full-grain leather composed of a grain layer and a leather fiber layer joined thereto;

a coating of elastomeric material disposed on and partway penetrated into said leather fiber layer in a region where said leather fiber layer is joined to said insole, said coating having a thickness above a surface of said leather fiber layer of at least 0.1 mm.

2. The athletic shoe according to claim 1, wherein said coating is also disposed in a region adjoining the region where said leather fiber layer is joined to said insole.

3. The athletic shoe according to claim 1, which further comprises reinforcing means embedded in said coating.

4. The athletic shoe according to claim 3, wherein said reinforcing means are an inlay of textile material.

5. The athletic shoe according to claim 4, wherein said inlay is a textile fabric inlay.

6. The athletic shoe according to claim 5, wherein said textile fabric inlay is formed of synthetic material with a weight per unit of surface area of less than 80 g/m$^2$ and a thickness of less than 0.25 mm.

7. The athletic shoe according to claim 3, wherein said reinforcing means comprise ground or cut fibers with a length of between 0.01 and 0.3 mm disposed in the coating.

8. The athletic shoe according to claim 3, wherein said reinforcing means are at least one seam penetrating said grain layer and said leather fiber layer.

9. The athletic shoe according to claim 8, wherein said seam is formed with a synthetic fiber thread.

10. The athletic shoe according to claim 9, wherein said thread is a polyamide fiber thread.

11. The athletic shoe according to claim 9, wherein said thread is a polyaramide thread.

12. The athletic shoe according to claim 8, wherein at least said seam is formed with an upper thread and a lower thread, and wherein said upper thread is a synthetic fiber thread.

13. The athletic shoe according to claim 8, wherein said seam is formed with a single thread sewn in a chain stitch.

14. The athletic shoe according to claim 8, wherein said vamp has a given edge and said at least one seam extends approximately parallel to said given edge.

15. The athletic shoe according to claim 14, wherein said seam which extends parallel to said given edge is covered by said outsole.

16. The athletic shoe according to claim 14, wherein said seam which extends parallel to said given edge is a zig-zag seam.

17. The athletic shoe according to claim 8, wherein said seam includes portions extending crosswise to an edge of said vamp.

18. The athletic shoe according to claim 17, wherein said crosswise portions extend into a region not covered by said outsole.

19. The athletic shoe according to claim 8, wherein said vamp has an edge and an edge region immediately adjacent said edge, and wherein said edge region immediately adjacent said edge is kept free of seams.

20. The athletic shoe according to claim 1, wherein said vamp, in locations at which said coating is applied, has fine pores formed therein defining a perforation.

21. The athletic shoe according to claim 20, wherein said perforation has at least 18 pores per square centimeter of vamp surface area.

22. The athletic shoe according to claim 20, wherein said perforation has more than 45 pores per square centimeter of vamp surface area.

23. The athletic shoe according to claim 1, wherein said vamp has a strip defined thereon which is kept free of said coating, said strip having a width between 2 mm and 8 mm and immediately adjoining an edge of said vamp.

24. The athletic shoe according to claim 1, wherein said coating is a polyurethane coating selected from the group consisting of a solidified polyurethane solution coating, a solidified, finely dispersed polyurethane dispersion, and a polyurethane reaction mixture.

25. The athletic shoe according to claim 1, wherein said coating has a hardness between 33 and 95 shore A.

26. The athletic shoe according to claim 25, wherein said coating has a hardness between 45 and 70 Shore A.

27. The athletic shoe according to claim 1, wherein said coating has a maximum thickness of 0.45 mm.

28. The athletic shoe according to claim 1, wherein a material of said coating is applied to said vamp under increased pressure.

29. The athletic shoe according to claim 1, wherein a material of said coating is applied to said vamp under a vacuum.

30. The athletic shoe according to claim 1, which further comprises seams penetrating said grain layer and said leather fiber layer wherein said outsole covers said grain layer at given locations, and said grain layer, at said given locations covered by said outsole, is subjected to roughening after the seams are formed.

* * * * *